US011096450B2

(12) United States Patent
Leonfellner

(10) Patent No.: US 11,096,450 B2
(45) Date of Patent: Aug. 24, 2021

(54) LACE LOCK SYSTEM

(71) Applicant: Perry Leonfellner, Fort St John (CA)

(72) Inventor: Perry Leonfellner, Fort St John (CA)

( * ) Notice: Subject to any disclaimer, the term of this patent is extended or adjusted under 35 U.S.C. 154(b) by 98 days.

(21) Appl. No.: 16/663,555

(22) Filed: Oct. 25, 2019

(65) Prior Publication Data

US 2021/0120918 A1 Apr. 29, 2021

(51) Int. Cl.
*A43C 7/08* (2006.01)
*A43C 7/04* (2006.01)

(52) U.S. Cl.
CPC . *A43C 7/08* (2013.01); *A43C 7/04* (2013.01)

(58) Field of Classification Search
CPC ..... A43C 7/08; A43C 7/04; A43C 11/008; A43C 11/00; A43C 11/06; A43C 3/00; Y10T 24/3703; Y10T 24/3718; Y10T 24/3724; Y10T 24/3716; Y10T 24/3742
See application file for complete search history.

(56) References Cited

U.S. PATENT DOCUMENTS 52,954 A * 3/1866 Borchardt ..... A43C 7/04 24/712.6
344,110 A * 6/1886 Johnson ..... B42F 1/06 24/563
470,584 A * 3/1892 Meyer ..... A43C 7/04 24/712.6
488,268 A * 12/1892 Meyer ..... A43C 7/00 24/712.2
514,284 A * 2/1894 Simmons ..... A43C 7/04 24/712.6
3,057,029 A * 10/1962 Miller, Jr. ..... A43C 7/04 24/712.6
3,137,952 A * 6/1964 Shears ..... A43C 11/14 36/50.1
3,221,384 A * 12/1965 Aufenacker ..... A43C 3/04 24/712.7
5,293,669 A * 3/1994 Sampson ..... A43C 11/14 24/16 PB
5,755,044 A * 5/1998 Veylupek ..... A43C 1/003 36/50.1
5,974,701 A 11/1999 Busch
(Continued)

FOREIGN PATENT DOCUMENTS

EP 2606760 A1 6/2013
WO 2012174269 A1 12/2012

*Primary Examiner* — Robert Sandy
*Assistant Examiner* — Rowland Do
(74) *Attorney, Agent, or Firm* — Argus Intellectual Enterprise; Daniel Enea; Jordan Sworen

(57) ABSTRACT

A lace lock system. The lace lock system is mountable to footwear and includes a latch having an aperture that receives a lace guide and is affixed to a cam. The lace guide is pivotally affixed to the cam and has a channel that receives a lace through the aperture. The lace lock is designed to transition between an open position and a locked position. In the locked position, the lace is tensioned to align a distal end of the cam within the channel of the lace guide, such that the distal end of the cam frictionally bears against the lace disposed in the channel. In the open position, the latch is rotated towards a first end of the lock, causing the distal end of the cam to misalign with the channel of the lace guide and release tension of the lace disposed in the channel.

15 Claims, 5 Drawing Sheets

(56) References Cited

U.S. PATENT DOCUMENTS

| | | | | |
|---|---|---|---|---|
| 6,119,318 | A * | 9/2000 | Maurer | A43C 3/00 24/130 |
| 6,802,439 | B2 | 10/2004 | Azam et al. | |
| 7,958,654 | B2 | 6/2011 | Reagan et al. | |
| 8,371,004 | B2 | 2/2013 | Huber et al. | |
| 9,814,281 | B2 | 11/2017 | Fisher et al. | |
| 2002/0083619 | A1* | 7/2002 | Durocher | A43C 3/00 36/50.1 |
| 2005/0102861 | A1 | 5/2005 | Martin | |
| 2008/0168685 | A1 | 7/2008 | Kim et al. | |
| 2008/0209702 | A1* | 9/2008 | Van Dine | A44B 11/12 24/68 SK |

* cited by examiner

LACE LOCK SYSTEM

BACKGROUND OF THE INVENTION

The present invention relates to a lace lock system. More specifically, the present invention relates to a lace lock system comprising a latch having an enclosed aperture sized to receive a lace guide, wherein the lace guide includes a channel adapted to receive a lace therethrough. The lace lock system allows for a wearer to pull on the lace to selectively tighten the lace so as to secure the footwear to the foot and leg of the wearer.

There exists several mechanisms and methods for tightening footwear around a wearer's foot and leg. A traditional method comprises threading a lace in a zig-zag pattern through eyelets that run in two parallel rows attached to opposite sides of the shoe. The shoe is tightened by first tensioning opposite ends of the threaded lace to pull the two rows of eyelets towards the midline of the foot and then tying the ends in a knot to maintain the tension. However, several drawbacks are associated with this type of lacing system.

First, conventional laces do not adequately distribute the tightening force along the length of the threaded zone. Friction between the lace and the eyelets cause portions of the lace to be slack, while other portions are in tension. Consequently, the higher tensioned portions of the shoe are tighter around certain sections of the foot, particularly the ankle portions which are closer to the lace ends.

Second, the laces are often difficult to untighten or redistribute tension on the lace, as the wearer must loosen the lace from each of the many eyelets through which the laces are threaded. The lace is not easily released by simply untightening the knot. The friction between the lace and the eyelets often maintains the toe portions, and sometimes much of the foot, in tension even when the knot is released. Consequently, the user must often loosen the lace from each of the individual eyelets. This is especially tedious if the number of eyelets is high and if the wearer is required to change footwear frequently.

In view of the above concerns, it is desirable to provide an embodiment of a lace lock system that distributes lateral tightening forces along the length of the wearer's ankle and foot. Particularly, it is desirable to provide a lace lock system that self-locks without the need to physically bend over and manipulate each lace. This is an especially useful feature for workers that require frequent donning and doffing of footwear and the elderly and disabled that possess limited mobility. Further, there is a need for a lace lock system that may be used in parallel on a single footwear to close tightly and maintain tension with continued use.

In light of the devices disclosed in the known art, it is submitted that the present invention substantially diverges in design elements and methods from the known art and consequently it is clear that there is a need in the art for an improvement for a lace lock system. In this regard the instant invention substantially fulfills these needs.

SUMMARY OF THE INVENTION

In view of the foregoing disadvantages inherent in the known types of lace lock systems now present in the known art, the present invention provides a new lace lock system for self-locking the lace in tension and releasing the tension when actuated without having to physically bend over and manipulate each lace.

It is an objective of the present invention to provide a lace lock comprising a latch having an enclosed aperture sized to receive a lace guide, wherein the latch is affixed to a cam at a first end of the lace lock such that the latch and the cam are adapted for cooperative movement. The lace guide includes a channel extending from a front side to an opposing rear side, wherein the channel is adapted to receive a lace therethrough. The lace guide is pivotally affixed to the cam at a pivot such that the pivot is located intermediate the first end of the lock and a distal end of the cam, thereby positioning the distal end of the cam within the channel.

It is therefore an object of the present invention to provide a new and improved lace lock system that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
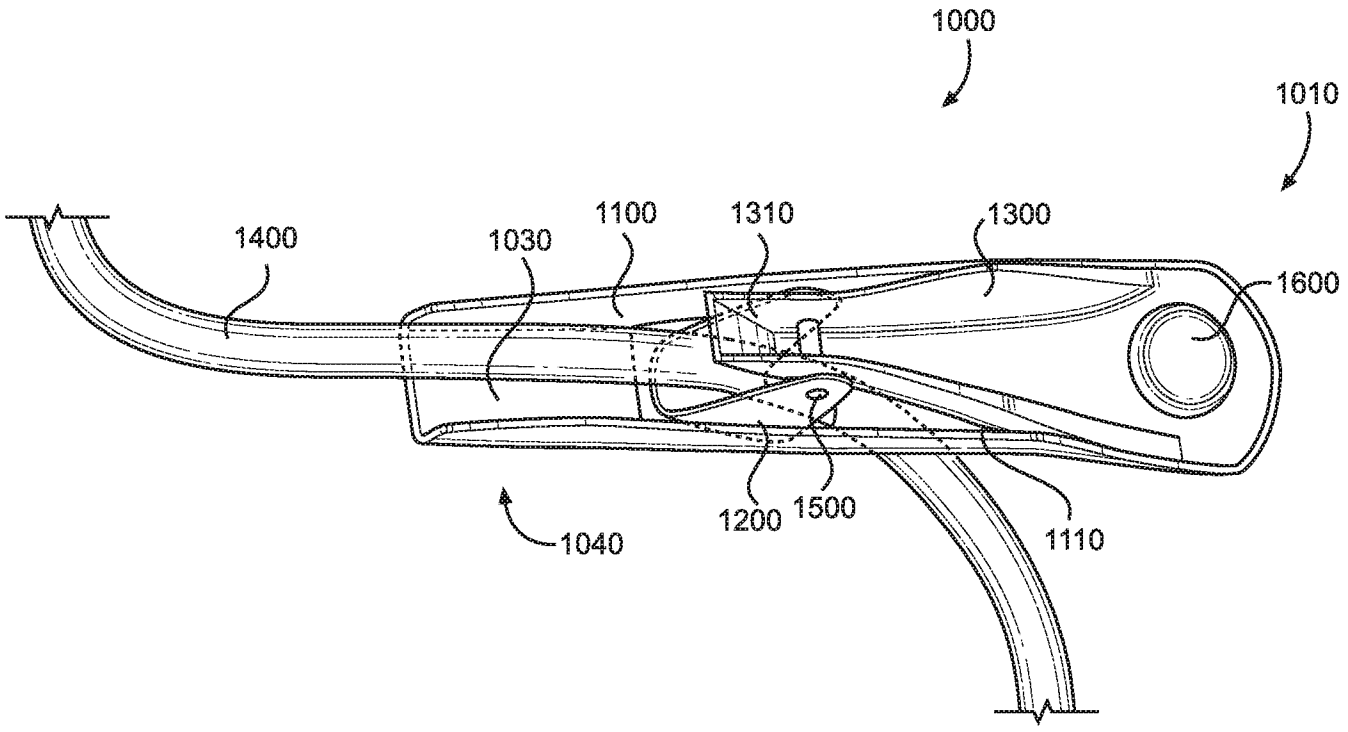
FIG. 1 shows a perspective view of an embodiment of the lace lock.

Reference is made herein to the attached drawings. Like reference numerals are used throughout the drawings to depict like or similar elements of the lace lock and system. For the purposes of presenting a brief and clear description of the present invention, the preferred embodiment will be discussed as used for tightening and releasing lace tension of a boot. The figures are intended for representative purposes only and should not be considered to be limiting in any respect.

Figure 2:
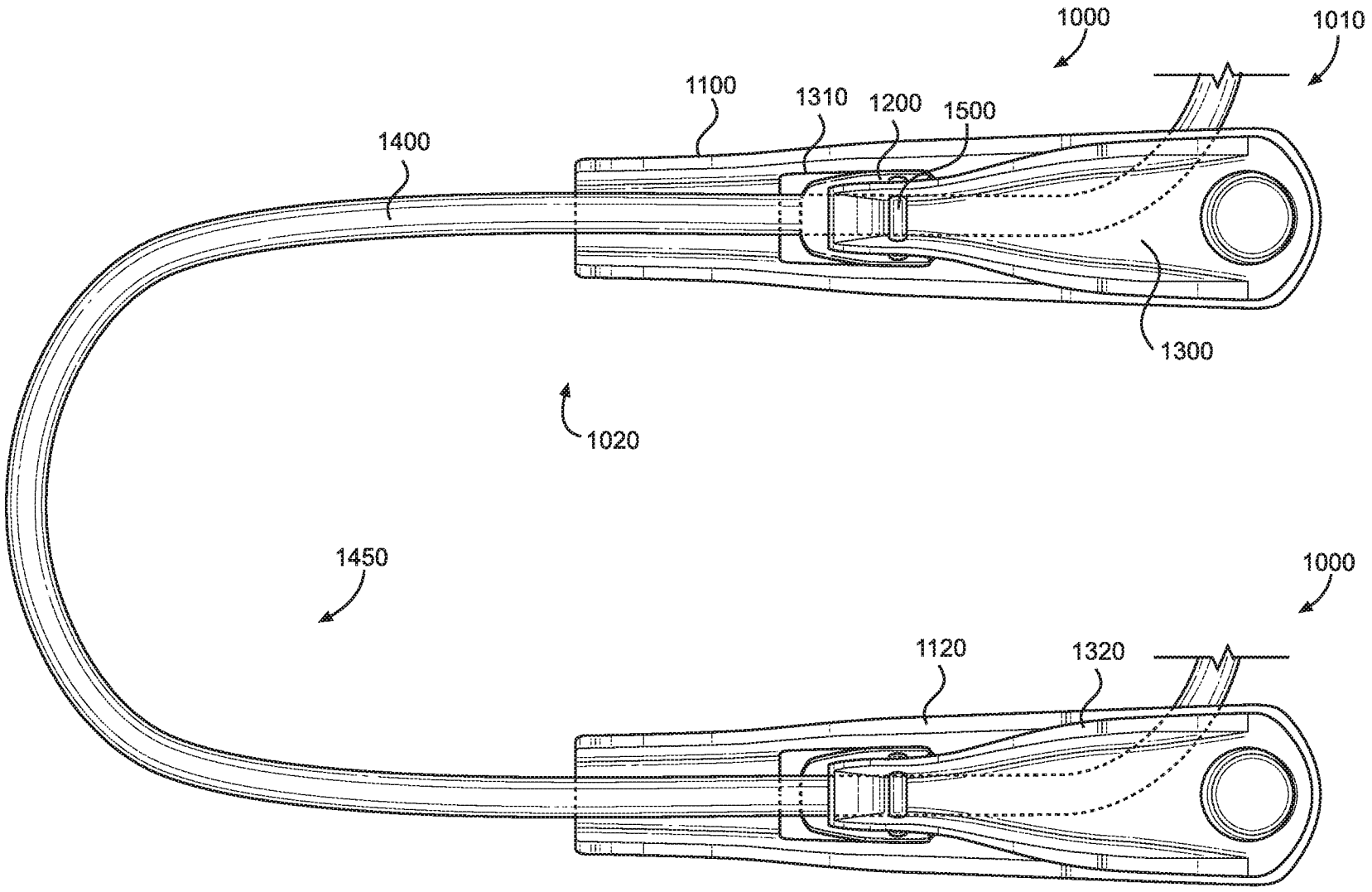
FIG. 2 shows an overhead view of an embodiment of the lace lock in a paired configuration.

Referring now to FIGS. 1 and 2, there is shown a perspective view of an embodiment of the lace lock and an overhead view of an embodiment of the lace lock system in a paired configuration, respectively. The present invention provides a lace lock 1000 that is affixed to footwear, such as a boot, such that the wearer may selectively tighten, and release lace tension of a lace secured thereto. The lace lock 1000 comprises a latch 1100 having an aperture 1110 sized to receive a lace guide 1200 therein. In one embodiment, the aperture 1110 is completely enclosed by the latch 1100. However, in alternative embodiments, the aperture is only partially enclosed by the latch 1100. The latch 1100 is affixed to a cam 1300 at a first end 1010 of the lock such that the latch 1100 and the cam 1300 are adapted for cooperative movement. In the shown embodiment, a rivet 1600 secures the latch 1100 to the cam 1300. In alternative embodiments, the latch 1100 and cam 1300 may be secured via any suitable fastener, such as by rivet, welding, snap fastener, and the like.

In the shown embodiment, the lace guide 1200 is pivotally affixed to the cam 1300 at a pivot 1500. The pivot 1500 is positioned intermediate the first end 1010 of the lace lock 1000 and a distal end 1310 of the cam 1300. In the shown embodiment, the pivot 1500 is a rod extending across the lace guide 1200. In alternative embodiments, the pivot 1500 may include any rotatable hinge. The lace guide 1200 further includes a channel 1210 extending from a front side 1030 to an opposing rear side, wherein the channel 1210 is adapted to receive a lace 1400 therethrough. The channel 1210 is positioned such that the distal end 1310 of the cam 1300 terminates within the channel 1210.

In the shown embodiment, the latch 1100 protrudes along a longitudinal axis away from the first end 1010. The latch 1100 provides a surface to handle on the rear side 1040 that allows a force to be applied to misalign the cam 1300 from the lace 1400 such that the cam 1300 reduces pressure on the lace 1400 (as shown in FIG. 4).

In the shown embodiment, the latch 1100 includes a lateral flange 1120 disposed on opposing sides thereof, wherein the lateral flange 1120 guides the lace 1400 when sliding thereacross. Further, the cam 1300 includes a cam flange 1320 that increases in height between the first end 1010 of the lace lock 1000 and the second end 1020 of the lace lock. In the shown embodiment, the cam flange 1320 is seated entirely within an interior of the lateral flange 1120 of the latch 1100 for compactness.

Referring specifically to FIG. 2, the lace lock system is shown in a paired configuration, wherein the lace 1400 is operably connected to at least two lace locks 1000. In the shown embodiment, the lace 1400 continuously extends between the first lace lock and the second lace lock to from a loop 1450. The first lace lock and the second lace lock are adjacent to each other, and no intermediate lace lock is positioned therebetween. The lace forms the loop 1450 so as to be graspable by hand or tool. Thus, by arranging the lace locks 1000 in this paired configuration, the wearer may easily apply tension to the lace 1400 by pulling the lace 1400 from the loop 1450 to tighten the lace 1400 in a locked configuration. In alternative embodiments, the lace 1400 is operably connected with any number of lace locks 1000 and may be operably connected with adjacent lace locks or nonadjacent or nonconsecutive lace locks.

Figure 3:
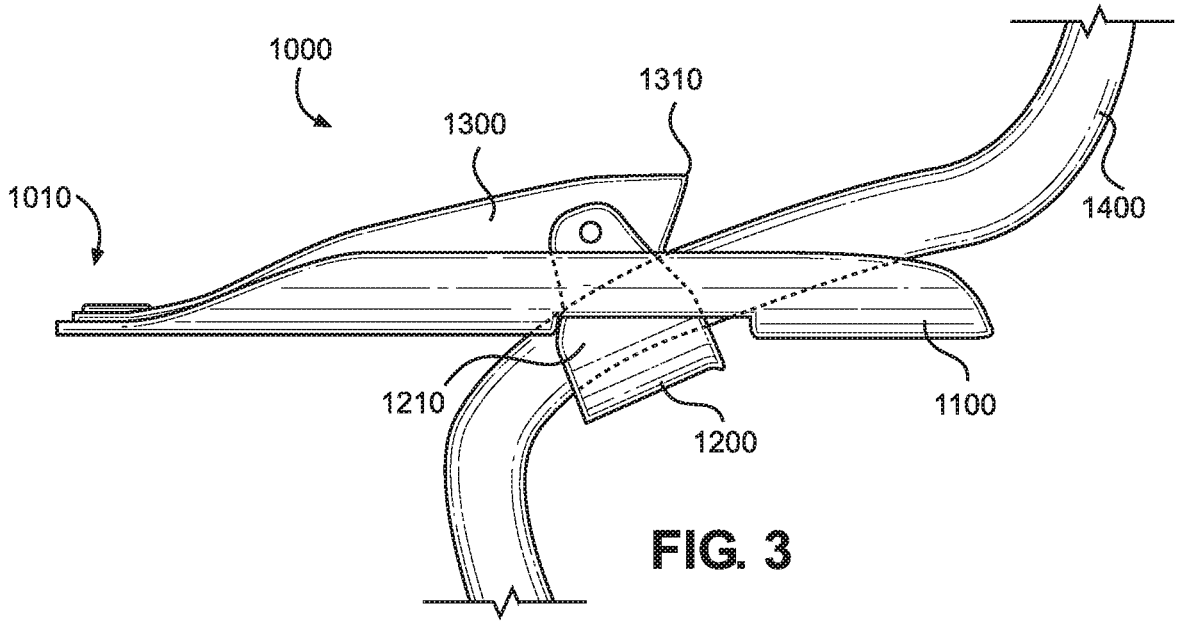
FIG. 3 shows a side view of an embodiment of the lace lock in an open configuration.
Figure 4:
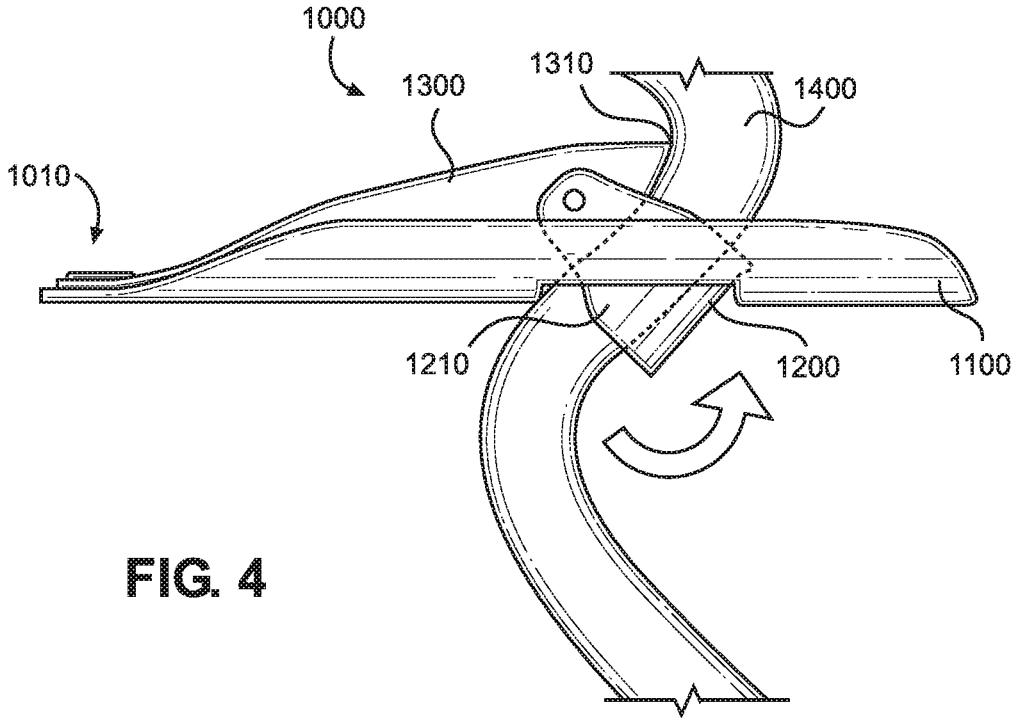
FIG. 4 shows a side view of an embodiment of the lace lock in a locked configuration.
Figure 5:
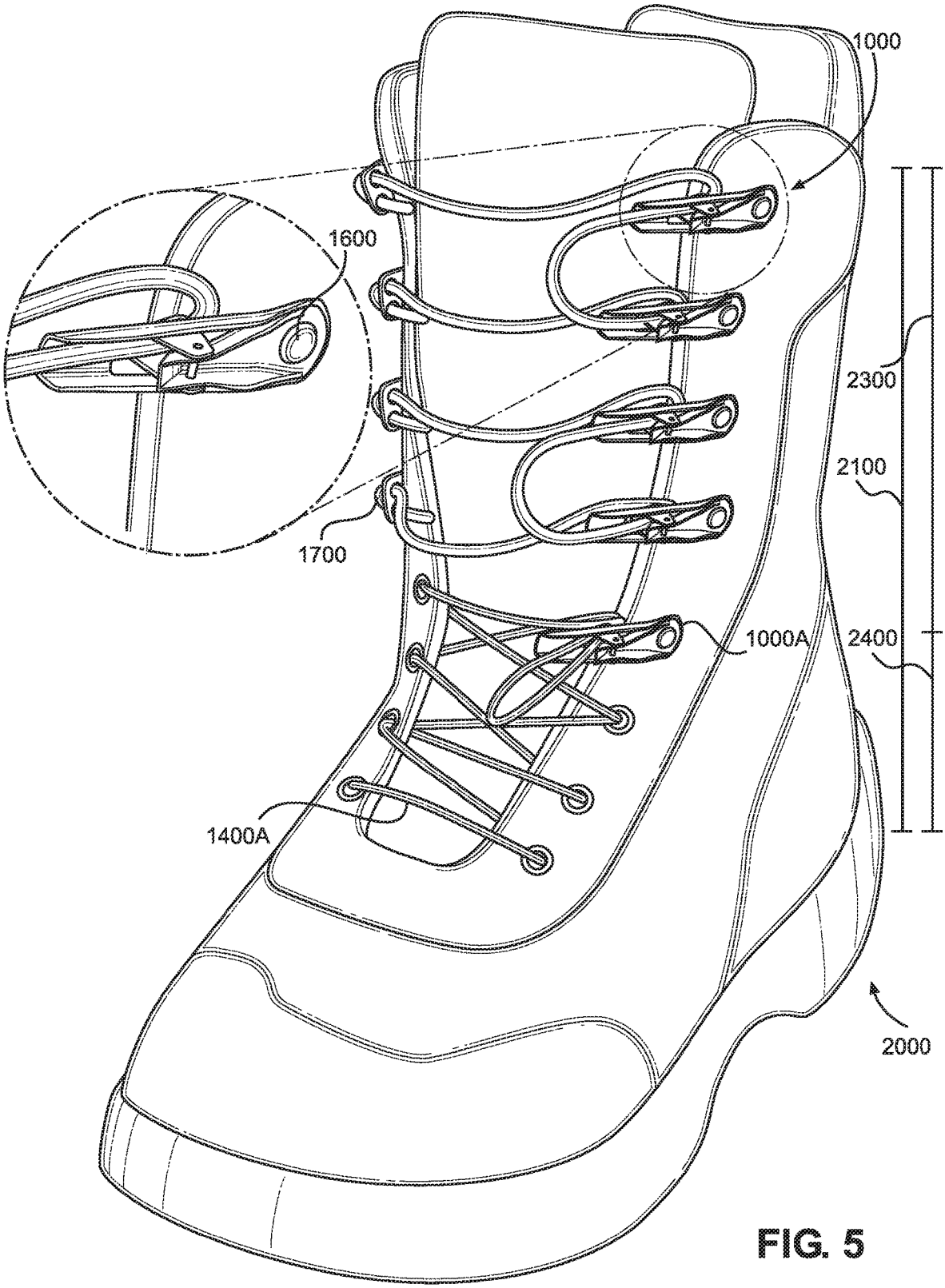
FIG. 5 shows a perspective view of an embodiment of the lace lock system mounted on a boot in an open configuration.
Figure 6:
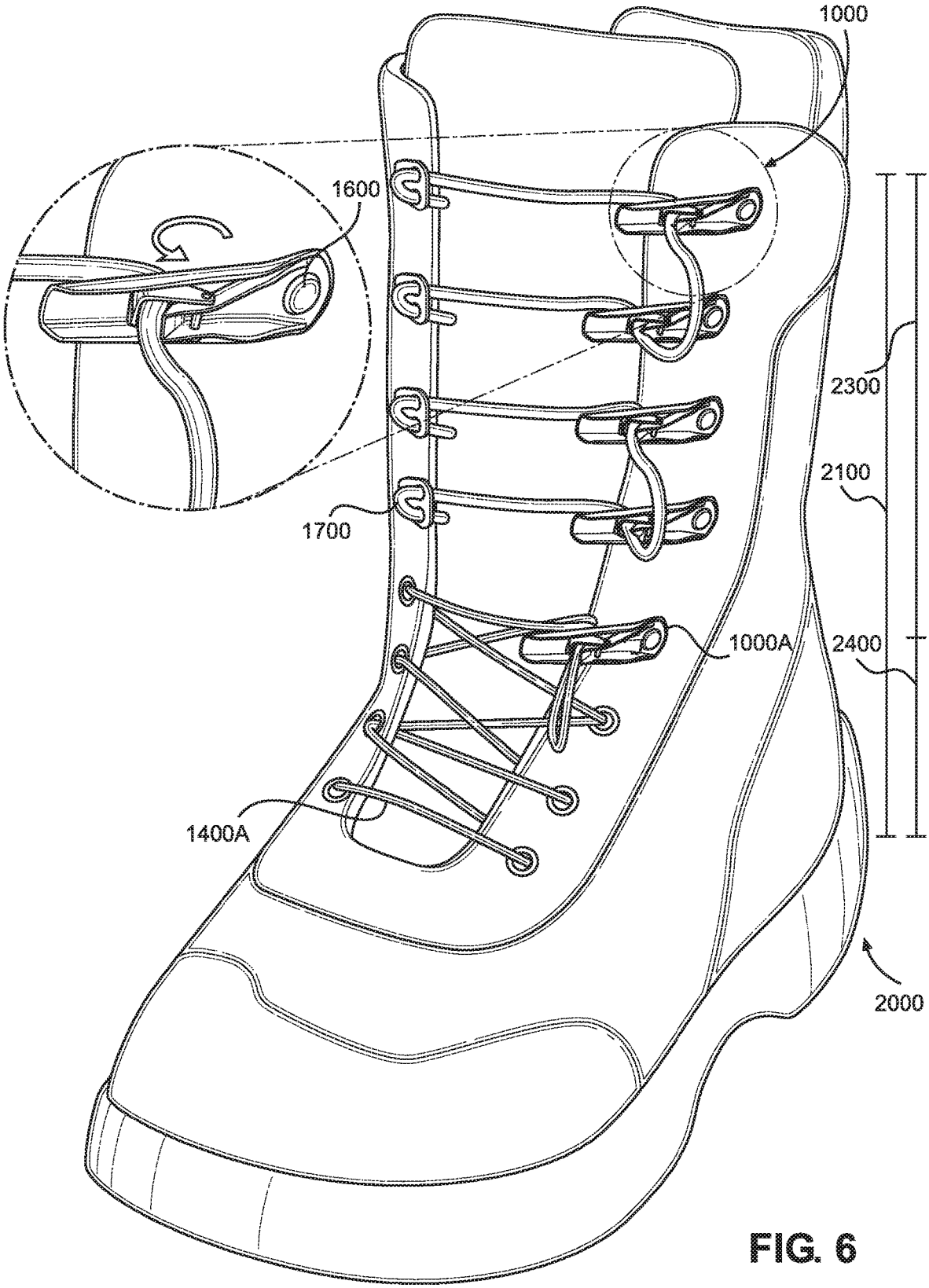
FIG. 6 shows a perspective view of an embodiment of the lace lock system mounted on a footwear in an locked configuration.

Referring now to FIGS. 3 and 4, there is shown a side view of an embodiment of the lace lock in an open and closed configuration, respectively. The lock lace 1000 is adapted to transition between the open position (as shown in FIGS. 3 and 5) and the locked position (as shown in FIGS. 4 and 6). In the locked position, the lace 1400 is tensioned so as to align the distal end 1310 of the cam 1300 within the channel 1210 of the lace guide 1200, such that the distal end 1310 frictionally bears against the lace 1400 disposed in the channel 1210.

In the shown embodiment, the open position is formed when the latch 1100 is rotated towards the first end 1010 of the lace lock 1000 causing the distal end 1310 of the cam 1300 to misalign with the channel 1210 of the lace guide 1200, thereby releasing the tension in the lace 1400 disposed in the channel 1210.

Referring now to FIGS. 5 and 6, there is shown a perspective view of an embodiment of the lace lock system mounted within a footwear in the open and locked configurations, respectively. The lace lock system 1000 comprises the footwear 2000 having an upper 2100 and a sole, wherein the footwear 2000 is adapted to cover a foot of a wearer.

In the shown embodiment, the lace lock 1000 is mounted to a first side of the upper 2100. The lace lock 1000 comprises a latch 1100 having an enclosed aperture 1110 sized to receive the lace guide 1200. The latch 1100 is affixed to a cam 1300 at a first end of the lace lock 1000, such that the latch 1100 and the cam 1300 are adapted for cooperative movement. In the shown embodiment, the latch 1100 is affixed to the cam 1300 via a rivet 1600, wherein the rivet 1600 secures the lace lock 1000 to the upper 2100 via the rivet 1600. In alternative embodiments, the lace lock 1000 is secured to the upper 2100 via any suitable fastener. The lace guide 1200 includes a channel 1210 adapted to receive the lace 1400 therethrough. The lace guide 1200 is pivotally affixed to the cam 1300 at a pivot 1500. In the shown embodiment, the footwear comprises a work boot. In alternative embodiments, the footwear comprises ski boots, hockey boots, sneakers or other types of shoes.

In the shown embodiment, the latch 1100 extends from the first end 1010 of the lace lock 1000 towards the opposing second side of the upper 2100. The lace 1400 is fixed to the second side of the upper 2100 via an eyelet 1700 that secures the lace 1400 therethrough wherein a knot tied to the end prevents passage of the lace 1400 through the eyelet 1700. The lace 1400 extends horizontally across a midline of the footwear 2000 and is threaded through the channel 1210. The midline of the footwear 2000 is defined as a vertical plane bisecting the first side and the second side of the upper 2100 through a tongue of the footwear 2000.

In the shown embodiment, the lace 1400 is operably connected to a pair of lace locks 1000 in a paired configuration, wherein the lace 1400 forms a loop 1450 graspable to tighten the lace 1400 in a locked configuration. The loop 1450 is graspable by hand or by a tool, such as a pole or other device. In one embodiment, the two pairs of lace locks 1000 in the paired configuration are disposed on the first side of the footwear 2000. In an alternative embodiment, a first pair of lace locks 1000 are disposed on the opposing side of the footwear 2000 from a second pair of lace locks (not shown). In one embodiment, each lace lock 1000 is independent from each other lace lock. In an alternative embodiment, all of the lace locks 1000 of the footwear 2000 are operably connected, so as to open and lock in unison.

In the shown embodiment, the upper 2100 forms a first zone/upper zone 2300 covering an ankle and leg of the wearer and a second zone/lower zone 2400 covering the top of the foot of the wearer. In one embodiment, a lower lace lock 1000A is operably connected to second lace 1400A disposed on the lower zone 2400. The separate zones 2300, 2400 of the boot 2000 may be independently tightened so that a wearer can adjust the level of tightness desired in a particular area. In the shown embodiment, the lower lace lock 1000A controls the tightness of the lower lace 1400A, wherein the lower lace 1400A is threaded through multiple eyelets disposed on both sides of the footwear 2000. In the shown embodiment, the lower lace lock 1000A controls the position (open or locked) of the entire lower zone 2300, 2400. In one embodiment, the lower lace lock 1000A is the fourth eyelet from the lowermost eyelet. In alternative embodiments, the lower lace lock 1000A is positioned at any location from the lowest eyelet.

In one embodiment, the first zone 2300 comprises two pairs of lace locks operably connected to two corresponding laces and the second zone 2400 comprises one lace lock operably connected to a single lace.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lace lock, comprising:

a latch having an enclosed aperture sized to receive a lace guide;

wherein the latch is affixed to a cam at a first end of the lace lock, such that the latch and the cam are adapted for cooperative movement;

the lace guide having a channel extending from a front side to an opposing rear side, wherein the channel is adapted to receive a lace therethrough;

wherein the lace guide is pivotally affixed to the cam at a pivot, the pivot disposed intermediate the first end of the lock and a distal end of the cam, such that the distal end of the cam terminates within the channel;

wherein the latch includes a lateral flange disposed on lateral sides of the latch, wherein the lateral flange is configured to guide the lace therein;

wherein the cam includes a cam flange such that the cam seats entirely within an interior of the flange of the latch.

2. The lace lock of claim 1, wherein the lace lock is adapted to transition between an open position and a locked position, wherein the locked position, the lace is tensioned so as to align the distal end of the cam within the channel of the lace guide, such that the distal end of the cam frictionally bears against the lace disposed in the channel.

3. The lace lock of claim 2, wherein the open position, the latch is rotated towards the first end of the lock causing the distal end of the cam to misalign with the channel of the lace guide and release the lace disposed in the channel.

4. The lace lock of claim 1, wherein the lace is operably connected to at least two lace locks.

5. The lace lock of claim 1, wherein the lace comprises a first end that is fixed to an eyelet of a footwear and a second end operably connected to the lace lock, wherein the eyelet and the lace lock are disposed on opposing sides of a midline of the footwear.

6. The lace lock of claim 1, wherein the lace is operably connected to at two lace locks in a paired configuration, wherein the lace forms a loop graspable to tighten the lace in a locked configuration.

7. The lace lock of claim 1, wherein the cam overlaps the latch and is positioned entirely within an outer perimeter of the latch.

8. A lace lock system for mounting to a footwear, comprising:

the footwear having an upper, wherein the footwear is adapted to cover a foot of a wearer;

a lace lock mounted to a first side of the upper, the lace lock comprising:

a latch having an enclosed aperture sized to receive a lace guide;

wherein the latch is affixed to a cam at a first end of the lace lock, such that the latch and the cam are adapted for cooperative movement;

the lace guide having a channel extending from a front side to an opposing rear side, wherein the channel is adapted to receive a lace therethrough;

wherein the lace guide is pivotally affixed to the cam at a pivot, the pivot disposed intermediate the first end of the lock and a distal end of the cam, such that the distal end of the cam terminates within the channel;

wherein the lace is fixed to the second side of the upper via an eyelet;

wherein the lace extends horizontally across a midline of the footwear and is threaded through the channel.

9. The lace lock system of claim 8, wherein the latch extends from the first end of the lace lock towards the opposing second side of the upper.

10. The lace lock system of claim 8, wherein the latch is affixed to the cam via a rivet.

11. The lace lock system of claim 10, wherein the lace lock is mounted to the upper via the rivet.

12. The lace lock system of claim 8, wherein the lace is operably connected to a pair of lace locks in a paired configuration, wherein the lace forms a loop graspable to tighten the lace in a locked configuration.

13. The lace lock system of claim 12, further comprising at least two pairs of lace locks in a paired configuration, wherein the two pairs of lace locks in a paired configuration are disposed on the first side of the upper.

14. The lace lock of claim 8, wherein the lace lock is disposed at a lowermost region of the footwear, wherein the lace is threaded through at least two eyelets in a zig-zag pattern across the first side and a second side of the upper.

15. The lace lock of claim 8, wherein the upper forms a first zone and a second zone;

wherein the first zone comprises two pairs of lace locks operably connected to two corresponding laces;

wherein the second zone comprises one lace lock operably connected to a single lace.

* * * * *